US008426712B1

(12) United States Patent
Lin

(10) Patent No.: US 8,426,712 B1
(45) Date of Patent: Apr. 23, 2013

(54) CYMBAL ROD ADJUSTING AND LOCATING MECHANISM

(75) Inventor: Yi Hsien Lin, Taoyuan County (TW)

(73) Assignee: K.H.S. Musical Instrument Co., Ltd., New Taipei (TW)

( * ) Notice: Subject to any disclaimer, the term of this patent is extended or adjusted under 35 U.S.C. 154(b) by 0 days.

(21) Appl. No.: 13/404,431

(22) Filed: Feb. 24, 2012

(30) Foreign Application Priority Data

Jan. 6, 2012 (TW) ..... 101200318 U

(51) Int. Cl.
*G10D 13/02* (2006.01)

(52) U.S. Cl.
USPC ..... 84/422.1

(58) Field of Classification Search ..... 84/422.1, 84/422.2, 422.3, 421
See application file for complete search history.

(56) References Cited

U.S. PATENT DOCUMENTS 5,388,495 A * 2/1995 Atsumi ..... 84/422.3

* cited by examiner

*Primary Examiner* — Kimberly Lockett
(74) *Attorney, Agent, or Firm* — Rabin & Berdo, P.C.

(57) ABSTRACT

A cymbal rod adjusting and locating mechanism includes a fixed casing having a pivot hole and a connector connected to a cymbal stand pole; and a movable casing including first and second clamping members for clamping a cymbal rod therebetween. The first clamping member is provided on a surface adjoining the second clamping member with a confining zone having a screw hole, and the second clamping member is correspondingly provided on a surface adjoining the first clamping member with a clamping zone having a through hole. The first and second clamping members are engaged with each other via a guiding mechanism provided between them, and are elastically pushed apart by first elastic elements provided between them. By extending a pressing bolt through the pivot hole and the through hole to screw into the screw hole, the fixed casing and the first and second clamping members are pressed against one another.

9 Claims, 9 Drawing Sheets

CYMBAL ROD ADJUSTING AND LOCATING MECHANISM

FIELD OF THE INVENTION

The present invention relates to a cymbal rod adjusting and locating mechanism for connecting a cymbal rod to a cymbal stand pole, and more particularly to a cymbal rod adjusting and locating mechanism that allows a user to quickly assemble and disassemble a cymbal rod to and from a cymbal stand pole, and to easily and stably adjust and locate the cymbal rod and accordingly a cymbal mounted thereto to different directions relative to the cymbal stand pole.

BACKGROUND OF THE INVENTION

A cymbal rod adjusting and locating mechanism is a connecting structure connected to between a cymbal rod and a cymbal stand pole; it not only enables mounting of the cymbal rod and accordingly a cymbal installed thereon to the cymbal stand pole, but also provides a means for adjusting the cymbal's position and orientation. With the cymbal rod adjusting and locating mechanism, a user can conveniently adjust the cymbal or any other musical instrument installed on the cymbal stand pole to a position most suitable for play.

FIG. 1 shows a first conventional cymbal rod adjusting and locating mechanism, which mainly includes a union 90 mounted to an upper end of a cymbal stand pole 51, and a cymbal rod holder 91 rotatably received in and connected to the union 90. The cymbal rod holder 91 is rotatably held to the union 90 via a locating screw 92, so that a cymbal rod 50 held in the cymbal rod holder 91 can be adjusted to different angles relative to the cymbal stand pole 51. A pressing screw 93 is provided on the cymbal rod holder 91. By tightening the pressing screw 93, the cymbal rod 50 is fixedly clamped in the cymbal rod holder 91. However, the illustrated first conventional cymbal rod adjusting and locating mechanism is uneasy to operate because it includes two separate screws, namely, the locating screw 92 and the pressing screw 93, for adjusting the cymbal rod's angular position and fixing the cymbal rod to the adjusted position, respectively. To solve this problem, another conventional cymbal rod adjusting and locating mechanism is developed to include only one single means for adjusting and clamping the cymbal rod to an adjusted position.

Please refer to FIG. 2. The second conventional cymbal rod adjusting and locating mechanism uses only one screw 94 to connect and lock the union 90 and the cymbal rod holder 91 to each other, so that the adjustment of the cymbal rod to different angular positions relative to the cymbal stand pole and the locating of the cymbal rod to the adjusted position can be completed at the same time by operating only one locating means, that is, the screw 94. While the second conventional cymbal rod adjusting and locating mechanism can be operated with reduced procedures to achieve both the adjusting and the locating of the cymbal rod, it becomes loose and unstable when the screw 94 is loosened therefrom for adjusting the angular position of the cymbal rod. This condition prevents a user from smoothly handling the whole adjusting and locating mechanism while parts and components thereof tend to become damaged due to incorrect locating when the screw 94 is retightened. In view of the above-mentioned drawbacks, it is necessary to improve the conventional cymbal rod adjusting and locating mechanisms.

SUMMARY OF THE INVENTION

A primary object of the present invention is to provide a cymbal rod adjusting and locating mechanism that allows a user to complete releasable clamping and adjustable locating of a cymbal rod relative to a cymbal stand pole through one single locating means; and includes an auxiliary guiding mechanism for stably supporting and maintaining different parts and components of the whole adjusting and locating mechanism in an always engaged state during adjustment, as well as elastic elements for elastically pushing apart the parts of the adjusting and locating mechanism to facilitate easy and accurate adjustment.

To achieve the above and other objects, the cymbal rod adjusting and locating mechanism according to the present invention includes a fixed casing, a movable casing, and a pressing bolt. The fixed casing is provided with a pivot hole and a connector for connecting to a cymbal stand pole. The movable casing is assembled from a first clamping member and a second clamping member to define a clamping space therein for clamping a cymbal rod thereto. The first clamping member is provided on a surface adjoining the second clamping member with a confining zone and a screw hole corresponding to the pivot hole on the fixed casing, and the second clamping member is provided on a surface adjoining the first clamping member with a clamping zone corresponding to the confining zone and a through hole corresponding to the pivot hole and the screw hole. A guiding mechanism is provided on the adjoining surfaces of the first and the second clamping member for normally engaging the first and the second clamping member with each other; and a plurality of first elastic elements is provided between the adjoining surfaces of the first and the second clamping member for elastically pushing apart the first and the second clamping member. The pressing bolt is sequentially extended through the pivot hole on the fixed casing and the through hole on the second clamping member to screw into the screw hole on the first clamping member, so as to press the fixed casing, the first clamping member and the second clamping member against one another through screwing.

In a preferred embodiment, the confining zone includes a curved protrusion horizontally projected toward the second clamping member and a first channel vertically extending through a center of the curved protrusion; and the clamping zone includes a curved recess corresponding to the curved protrusion and a second channel corresponding to the first channel; and the first and the second channel together define the clamping space in the movable casing for the cymbal rod to assemble thereto.

In another preferred embodiment, the screw hole formed on the first clamping member is located on the curved protrusion.

In a further preferred embodiment, the guiding mechanism includes at least one guide post located on and laterally projected from the adjoining surface of the first clamping member, and at least one guide hole formed on and sunken from the adjoining surface of the second clamping member to locate corresponding to the guide post.

In a preferred embodiment, the cymbal rod adjusting and locating mechanism further includes a second elastic element located between the fixed casing and the first clamping member for elastically pushing the fixed casing and the first clamping member away from each other.

In another preferred embodiment, the cymbal rod adjusting and locating mechanism further includes a locating device provided on two adjoining surfaces of the fixed casing and the movable casing for a user to change an angle by which the movable casing is rotated relative to the fixed casing.

In a further preferred embodiment, the locating device includes an annular tooth array and at least one locating tooth for meshing with the annular tooth array.

In a preferred embodiment, the cymbal rod adjusting and locating mechanism further includes an indicator unit provided on outer circumferential surfaces of the fixed casing and the movable casing at positions adjoining a joint between the two casings for indicating an angle by which the movable casing is rotated relative to the fixed casing.

In another preferred embodiment, the indicator unit includes a set of angle scales provided on the outer circumferential surface of the fixed casing and at least one index scale provided on the outer circumferential surface of the movable casing for correspondingly aligning with one of the angle scales when the movable casing is rotated.

The present invention is characterized in that it includes a fixed casing, on which a connector and a pivot hole are arranged perpendicular to each other; a pressing bolt; and a movable casing rotatably connected to the fixed casing via the pressing bolt. The movable casing is assembled from a first and a second clamping member. The first clamping member is provided on a surface adjoining the second clamping member with a confining zone having a screw hole as well as a plurality of projected guide posts; and the second clamping member is provided on a surface adjoining the first clamping member with a clamping zone corresponding to the confining zone, a through hole located corresponding to the screw hole, and a plurality of sunken guide holes corresponding to the guide posts. And, a set of first elastic elements is provided between the adjoining surfaces of the first and the second clamping member to elastically push them away from each other.

By sequentially extending the pressing bolt through the fixed casing and the second clamping member to screw into the first clamping member at one time, a user is able to adjust the rotation angle of the movable casing relative to the fixed casing and to detach or firmly clamp a cymbal rod from or between the first and the second clamping member with only one simple step. Meanwhile, with the engagement of the guide posts with the guide holes and the effect of the first elastic elements, the whole cymbal rod adjusting and locating mechanism would not become loose and separated even when the pressing bolt is loosened for adjusting the angular position of the cymbal rod relative to the cymbal stand pole. With these arrangements, the user can more easily handle the adjustment and location of a cymbal rod on a cymbal stand pole without causing damage to parts and components of the adjusting and locating mechanism due to mistakes made during adjusting and locating the cymbal rod.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

The present invention will now be described with some preferred embodiments thereof and with reference to the accompanying drawings.

Figure 1:
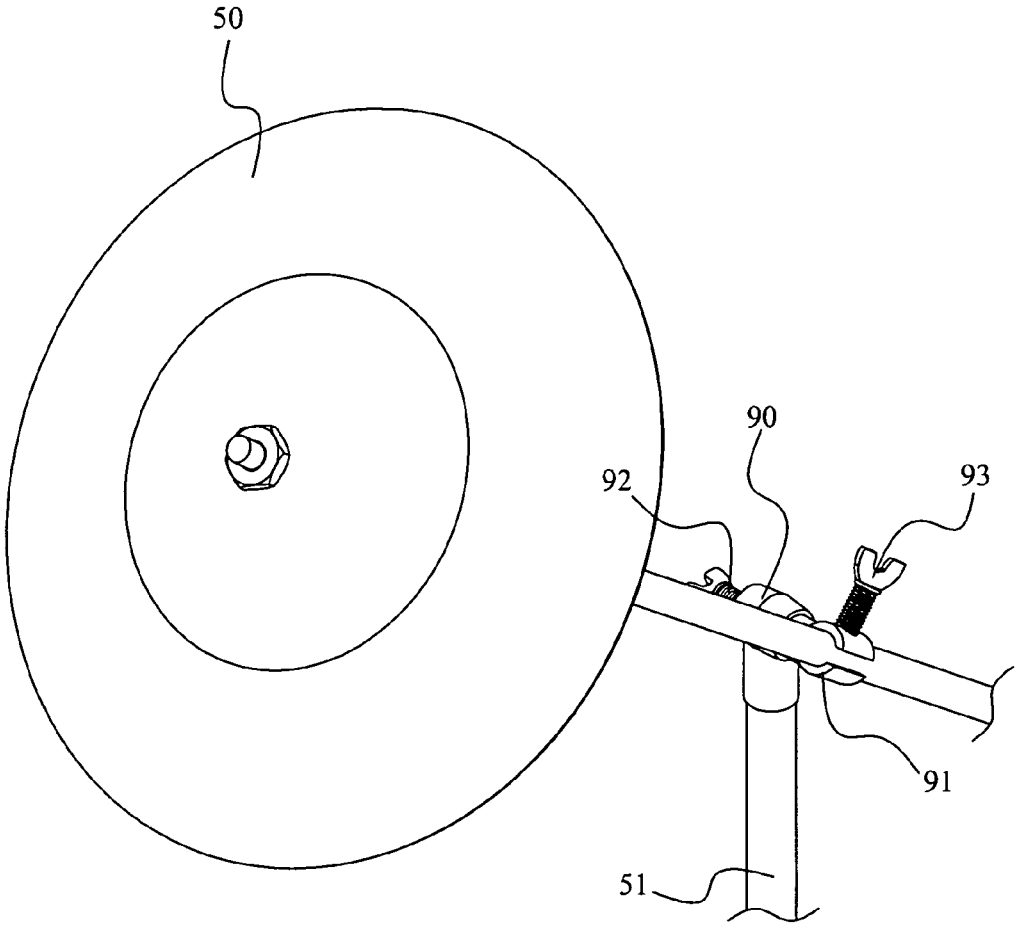
(Prior Art) FIG. 1
FIG. 1 is a perspective view showing a first conventional cymbal rod adjusting and locating mechanism.
Figure 2:
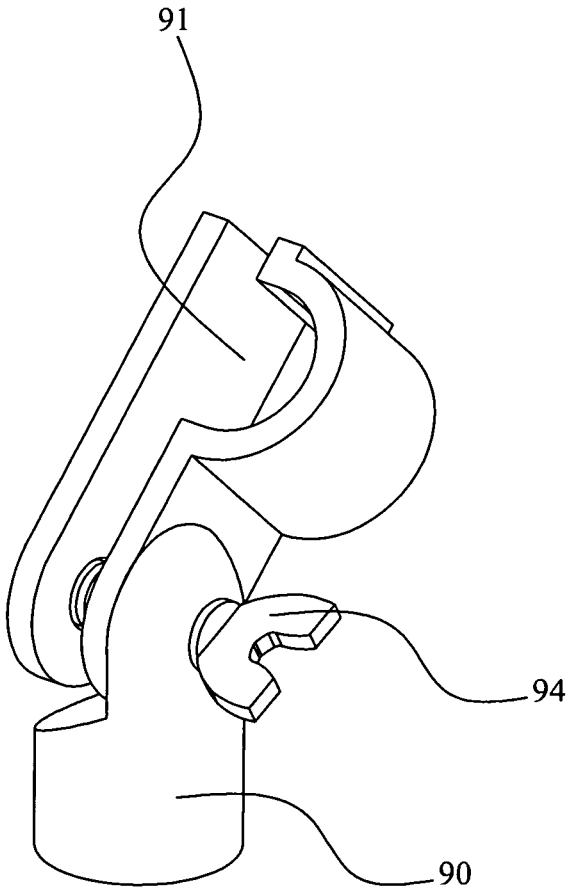
(Prior Art) FIG. 2
FIG. 2 is a perspective view showing a second conventional cymbal rod adjusting and locating mechanism.
Figure 3:
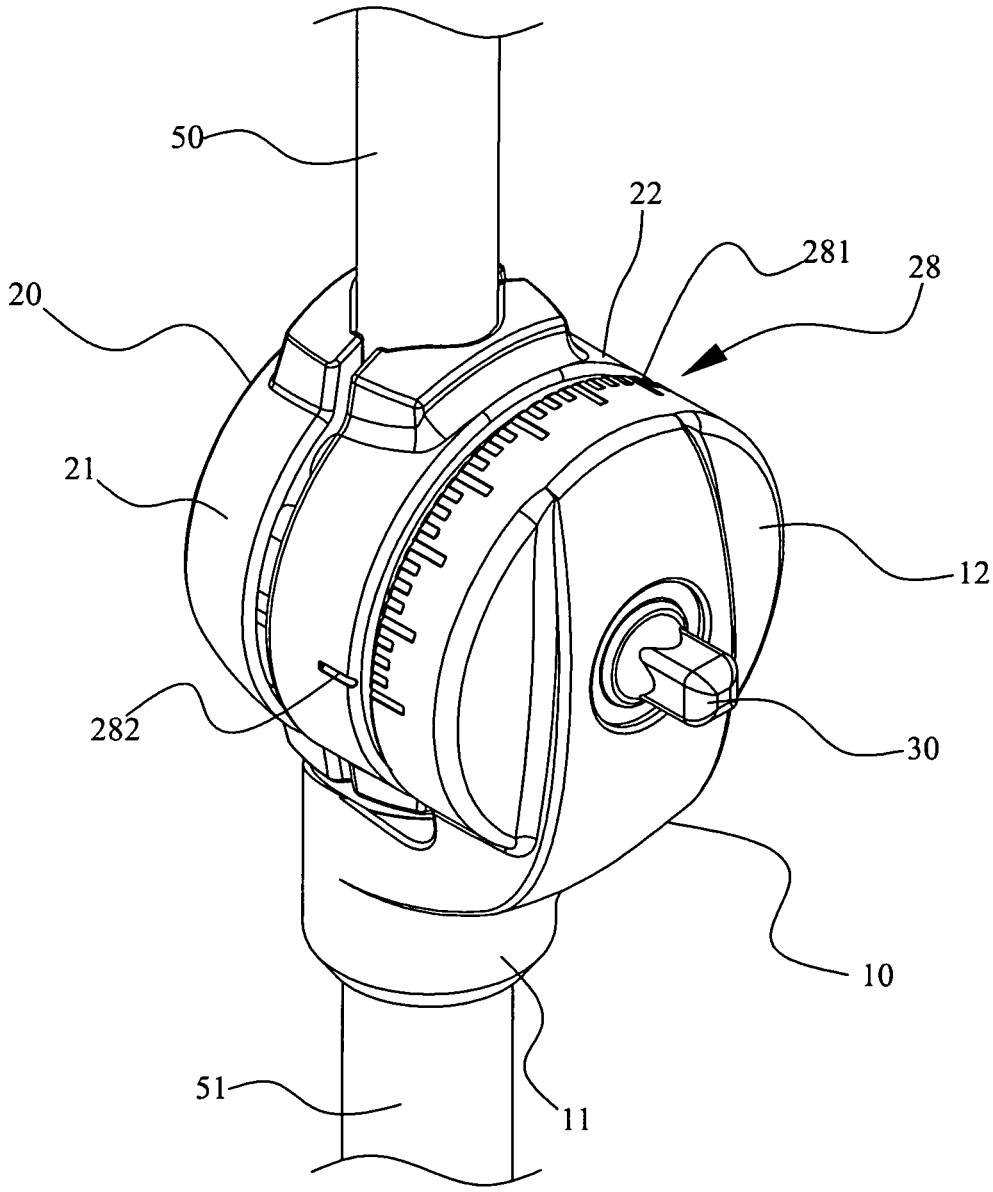
FIG. 3 is an assembled perspective view of a cymbal rod adjusting and locating mechanism according to an embodiment of the present invention.
Figure 4:
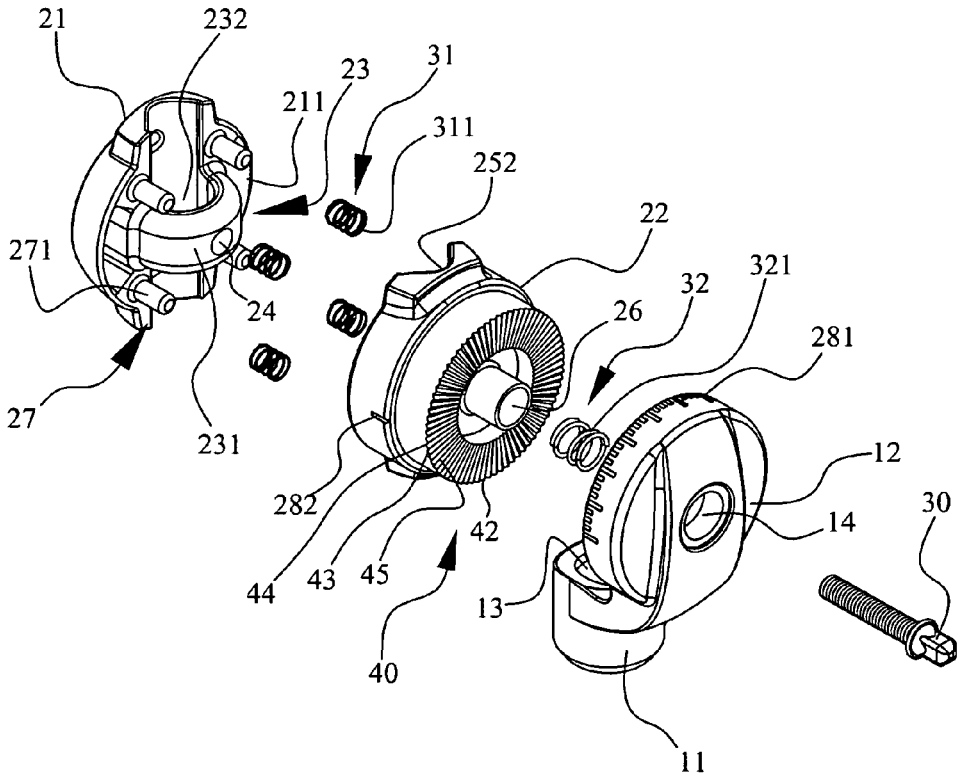
FIG. 4 is an exploded perspective view of the cymbal rod adjusting and locating mechanism of FIG. 3.

Please refer to FIGS. 3 and 4 that are assembled and exploded perspective views, respectively, of a cymbal rod adjusting and locating mechanism according to an operable embodiment of the present invention. As shown, in the illustrated embodiment, the cymbal rod adjusting and locating mechanism includes a fixed casing 10, a movable casing 20 movably connected to one side of the fixed casing 10, and a pressing bolt 30 releasably tightening the fixed casing 10 and the movable casing 20 to each other.

In the illustrated operable embodiment, the fixed casing 10 has a substantially L-shaped configuration having a horizontal base 11 and a connecting arm 12 perpendicularly upward extended from one lateral side of the base 11. A connector 13 is provided on the base 11 for a cymbal stand pole 51 to assemble thereto. In the illustrated embodiment, the connector 13 is configured as a connection hole but is not necessarily limited thereto. A pivot hole 14 is formed on the connecting arm 12 for the movable casing 20 to rotatably assemble thereto. The pressing bolt 30 is sequentially extended through the pivot hole 14 to screw to the movable casing 20, so that the movable casing 20 is rotatably connected to the fixed casing 10. Since the connector 13 and the pivot hole 14 have centerlines substantially perpendicular to each other, the movable casing 20 is allowed to rotate about an axis perpendicular to an axial direction of the cymbal stand pole 51.

The movable casing 20 is assembled from a first clamping member 21 and a second clamping member 22 that can be clamped to each other. To facilitate clear description, a surface of the first clamping member 21 adjoining the second clamping member 22 is herein referred to as a first surface 211, and a surface of the second clamping member 22 adjoining the first clamping member 21 is herein referred to as a second surface 221.

To enable stable clamping of a cymbal rod 50 or other possible musical instrument, a confining zone 23 having a screw hole 24 is provided on the first surface 211, while a clamping zone 25 configured corresponding to the confining zone 23 is provided on the second surface 221 and has a through hole 26 formed thereon to correspond to the screw hole 24. Further, a guiding mechanism 27 is provided between the first clamping member 21 and the second clamping member 22, and a plurality of first elastic elements 31 is mounted on the guiding mechanism 27, so that the first and the second clamping member 21, 22 are correspondingly assembled to each other to fixedly clamp the cymbal rod 50 or other possible musical instrument therebetween.

Figure 5:
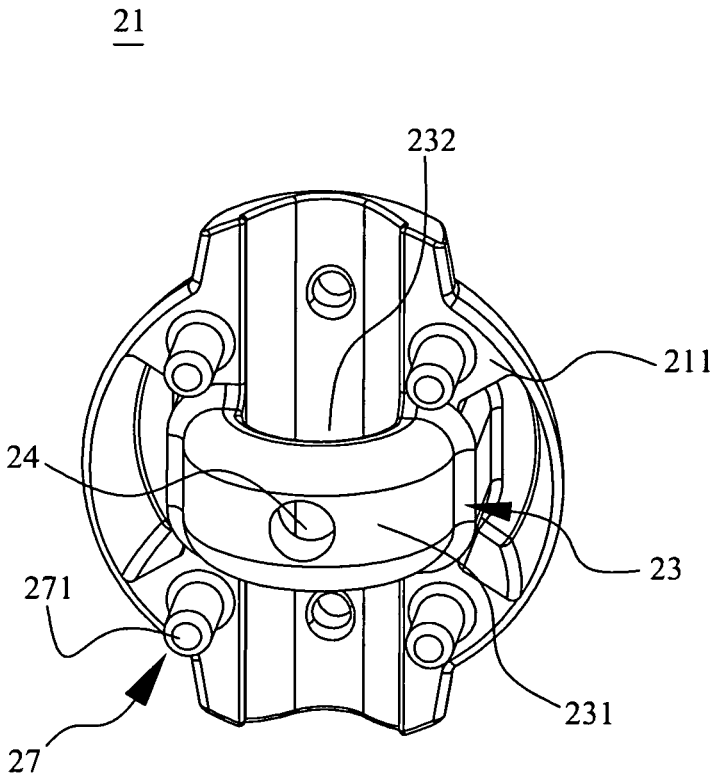
FIG. 5 is a perspective view of a first clamping member for the cymbal rod adjusting and locating mechanism of the present invention.
Figure 6:
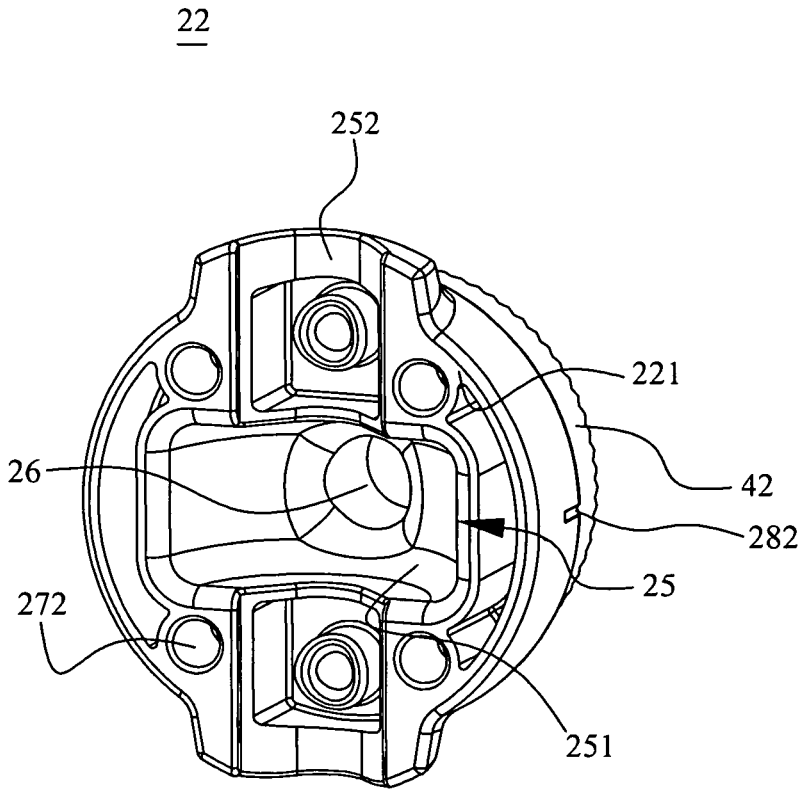
FIG. 6 is a perspective view of a second clamping member for the cymbal rod adjusting and locating mechanism of the present invention.

Please refer to FIGS. 4 to 6, in which detailed structures of the confining zone 23, the clamping zone 25 and the guiding mechanism 27 are illustrated. In the illustrated embodiment, the confining zone 23 includes a curved protrusion 231 and a first channel 232 longitudinally extending through the curved protrusion 231; and the clamping zone 25 includes a curved recess 251 corresponding to the curved protrusion 231 and a second channel 252 corresponding to the first channel 232. More specifically, the curved protrusion 231 is configured as a horizontally arranged semicircular protrusion and the curved recess 251 is correspondingly configured as a semicircular recess. Since the semicircular protrusion 231 has a long rectangular cross section, it would not easily turn and displace after being fitted in the semicircular recess 251. When the cymbal rod 50 or other possible musical instrument that is to be fixed in place is extended into the first channel 232 and the second clamping member 22 is then caused to tightly press against the first clamping member 21, the cymbal rod 50 or the musical instrument will be fixedly held to between the first and the second channel 232, 252.

To further increase the stability in assembling the first clamping member 21 to the second clamping member 22, the guiding mechanism 27 includes four guide posts 271, which are projected from the first surface 211 and located around the curved protrusion 231, and four guide holes 272 provided on and sunken from the second surface 221 to locate corresponding to the four guide posts 271. Through engagement of the guide posts 271 with the guide holes 272, the first and the second clamping member 21, 22 may still be held in place even when the pressing bolt 30 is loosened. The first elastic elements 31 include a plurality of compression springs 311, which respectively have an inner diameter slightly larger than an outer diameter of the guide post 271 for fitting around the guide posts 271. Further, with the four guide posts 271 and the compression springs 311 equally spaced around the pressing bolt 30, the first clamping member 21 and the second clamping member 22 can be evenly pushed apart by the compression springs 311 without completely separating from each other.

The screw hole 24 is provided on a top, i.e. a lateral central point, of the curved protrusion 231, and the through hole 26 is provided on a bottom, i.e. a lateral central point, of the curved recess 251 for the pressing bolt 30 to extend therethrough. With these arrangements, the location for locking the pressing bolt 30 not only overlaps with the location for receiving the cymbal rod 50, but also passes through a central area of the movable casing 20. Therefore, the first clamping member 21 and the second clamping member 22 can be locked to each other with increased stability, and it is possible to avoid mutual interference between the pressing bolt 30 and the cymbal rod 50.

As can be seen in FIG. 4, a second elastic element 32 can be further provided between the fixed casing 10 and the first clamping member 21. In the illustrated embodiment, the second elastic element 32 is configured as one single second compression spring 321, which has an inner diameter sized between a diameter of the through hole 26 and a screw diameter of the pressing bolt 30 for fitting around the pressing bolt 30, such that the second compression spring 321 has an end pressed against the fixed casing 10 and another opposite end against the first clamping member 21 to elastically push them apart from each other.

For the movable casing 20 to rotate at increased accuracy, a locating device 40 is further provided on two adjoining surfaces of the fixed casing 10 and the movable casing 20, enabling a user to record a rotation angle by which the movable casing 20 is rotated relative to the fixed casing 10. In the illustrated preferred embodiment, the locating device 40 includes a first annular tooth array 41 provided on the fixed casing 10 and a second annular tooth array 42 provided on an outer surface of the second clamping member 22. Both the first and the second annular tooth array 41, 42 include a plurality of successively arranged and radially extended locating teeth 45. In the illustrated embodiment, the first annular tooth array 41 and the second annular tooth array 42 mesh with each other and are located around the pressing bolt 30. When a user rotates the movable casing 20, the meshed annular tooth arrays 41, 42 will provide a certain magnitude of feedback force. Since the feedback force will have periodically changed strength according to the rotation angle, it can serve as a means for the user to determine the rotation angle and accordingly allows the user to conveniently rotate the movable casing 20 to a desired position relative to the fixed casing 10. However, it is understood the above structured locating device 40 is illustrated only as an example to facilitate explanation of the present invention without being intended to limit the same in any way. The above-mentioned first annular tooth array 41 and the second annular tooth array 42 can mesh with each other in other manners without being limited to the manner as described above. That is, the user may change the first annular tooth array 41 or the second annular tooth array 42 to be one single locating tooth 45 or a certain number of locating teeth 45. A feedback force can also be provided when the locating tooth or teeth 45 engage with the annular tooth array 41 or 42. Alternatively, a suspension arm can be additionally provided on the locating teeth 45 for regulating the magnitude of the feedback force.

Figure 7:
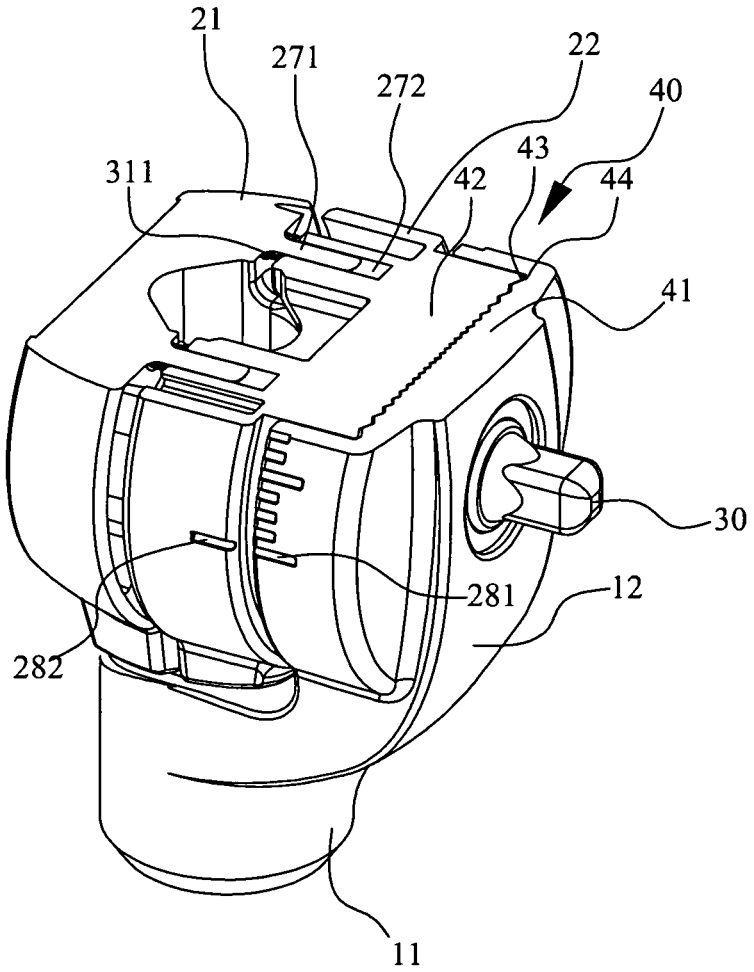
FIG. 7 is a sectional top perspective view showing the cymbal rod adjusting and locating mechanism of the present invention in a tightened state.
Figure 8:
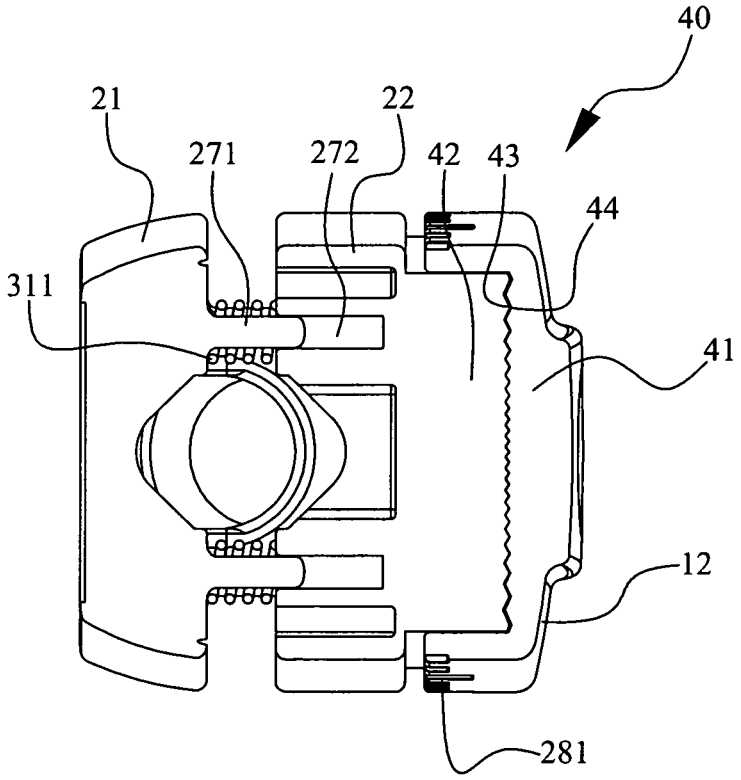
FIG. 8 is another sectional top perspective view showing the cymbal rod adjusting and locating mechanism of the present invention in a loosened state.
Figure 9:
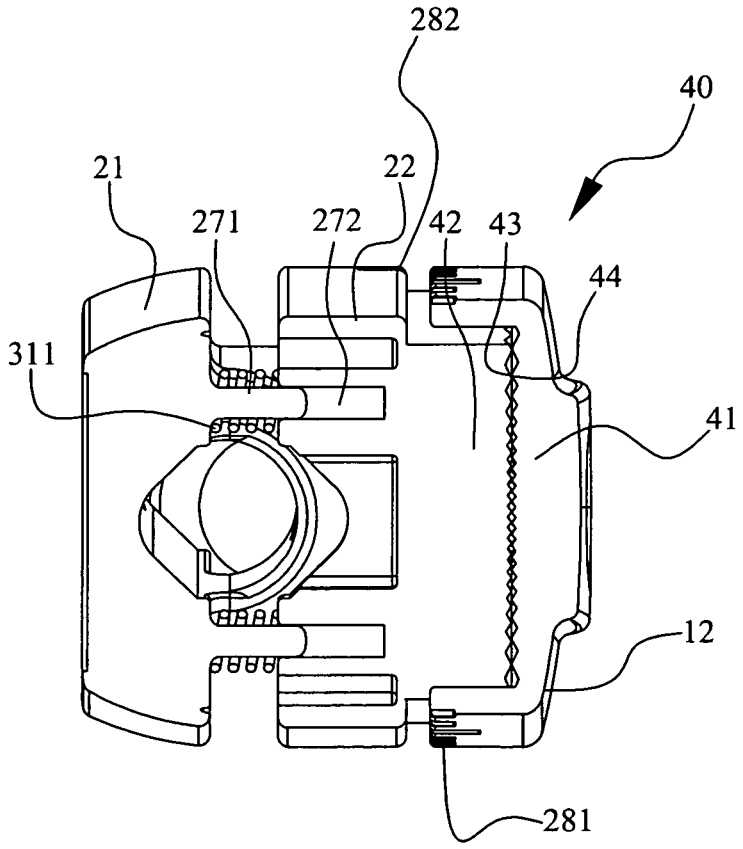
FIG. 9 is a further sectional top perspective showing the rotating of a movable casing of the cymbal rod adjusting and locating mechanism of the present invention.

Please refer to FIGS. 7 to 9 that illustrate the manner in which a user adjusts and rotates the movable casing 20. When the user tightens the pressing bolt 30, the movable casing 20 and the fixed casing 10 are brought to closely connect to each other. At this point, the first clamping member 21 and the second clamping member 22 are also brought to move closely toward each other, so that the second channel 252 and the first channel 232 close to each other to together clamp the cymbal rod 50 therebetween. Meanwhile, the first compression springs 311 arranged between the first and the second clamping member 21, 22 are brought to push against the second clamping member 22, bringing the first annular tooth array 41 and the second annular tooth array 42 to tightly mesh with each other to thereby prevent the movable casing 20 from rotating relative to the fixed casing 10.

On the other hand, when the user loosens the pressing bolt 30, the first compression springs 311 elastically push the first and the second clamping member 21, 22 away from each other while the second compression spring 321 elastically pushes the first clamping member 21 and the fixed casing 10 away from each other, so that a margin space is formed between the first and the second clamping member 21, 22 and the first compression springs 311 are allowed to elastically stretch. At this point, the second annular tooth array 42 can be freely rotated relative to the first annular tooth array 41, and the feedback force between the first and the second annular tooth array 41, 42 is affected by the degree of compression of the second compression spring 321. When the first annular tooth array 41 and the second annular tooth array 42 are located with their tooth tips 43 aligned with one another, the second compression spring 321 is subjected to a maximum compression degree and a maximum feedback force can be provided. On the other hand, when the tooth tips 43 of the first annular tooth array 41 are aligned with tooth roots 44 of the second annular tooth array 42, the second compression spring 321 is subjected to a minimum compression degree and a minimum feedback force can be provided. Therefore, the user may conveniently know the rotation angle from the feedback force that periodically changes with the angle by which the movable casing 20 is rotated relative to the fixed casing 10.

Please refer to FIGS. 3 and 4. For the user to conveniently recognize the rotation angle of the movable casing 20, an indicator unit 28 is further provided on outer circumferential surfaces of the movable and the fixed casing 20, 10 at positions adjoining a joint between the two casings 10, 20. In the illustrated preferred embodiment, the indicator unit 28 includes a set of angle scales 281 provided on the outer circumferential surface of the fixed casing 10 and a set of index scales 282 provided on the outer circumferential surface of the movable casing 20. The set of angle scales 281 covers an upper 180° area of the circumferential surface of the fixed casing 10. The set of index scales 282 includes only two scales located at two diametrically opposite lateral ends of the movable casing 20 to space from each other by 180°. When the user rotates the movable casing 20, the two index scales 282 can indicate the angle by which the movable casing 20 is currently rotated.

In summary, the present invention includes a fixed casing, on which a connector and a pivot hole are arranged perpendicular to each other; a pressing bolt; and a movable casing rotatably connected to the fixed casing via the pressing bolt. The movable casing is assembled from a first and a second clamping member. The first clamping member is provided on a surface adjoining the second clamping member with a confining zone having a screw hole as well as a plurality of projected guide posts; and the second clamping member is provided on a surface adjoining the first clamping member with a clamping zone corresponding to the confining zone, a through hole located corresponding to the screw hole, and a plurality of sunken guide holes corresponding to the guide posts. And, a set of first elastic elements is provided between the adjoining surfaces of the first and the second clamping member to elastically push them away from each other.

By sequentially extending the pressing bolt through the fixed casing and the second clamping member to screw to the first clamping member at one time, a user is able to adjust the rotation angle of the movable casing relative to the fixed casing and to detach or firmly clamp a cymbal rod from or between the first and the second clamping member with only one simple step. Meanwhile, with the engagement of the guide posts with the guide holes and the effect of the first elastic elements, the whole cymbal rod adjusting and locating mechanism would not become loose and separated even when the pressing bolt is loosened for adjusting the angular position of the cymbal rod relative to the cymbal stand pole. With these arrangements, the user can more easily handle the adjustment and location of a cymbal rod on a cymbal stand pole without causing damage to parts and components of the adjusting and locating mechanism due to mistakes made during adjusting and locating the cymbal rod.

The present invention has been described with some preferred embodiments thereof and it is understood that many changes and modifications in the described embodiments can be carried out without departing from the scope and the spirit of the invention that is intended to be limited only by the appended claims.

What is claimed is:

1. A cymbal rod adjusting and locating mechanism for adjustably connecting a cymbal rod to a cymbal stand pole, comprising:

a fixed casing being provided with a pivot hole and a connector; and the cymbal stand pole being assembled the connector;

a movable casing being assembled from a first clamping member and a second clamping member to define a clamping space therein; the first clamping member being provided on a surface adjoining the second clamping member with a confining zone and a screw hole corresponding to the pivot hole on the fixed casing, and the second clamping member being provided on a surface adjoining the first clamping member with a clamping zone corresponding to the confining zone and a through hole corresponding to the pivot hole and the screw hole; a guiding mechanism being provided on the adjoining surfaces of the first and the second clamping member for engaging the first and the second clamping member with each other; and a plurality of first elastic elements being provided between the adjoining surfaces of the first and the second clamping member for elastically pushing the first and the second clamping member away from each other; and a pressing bolt being sequentially extended through the pivot hole on the fixed casing and the through hole on the second clamping member to screw into the screw hole on the first clamping member, so as to press the fixed casing, the first clamping member and the second clamping member against one another through screwing.

2. The cymbal rod adjusting and locating mechanism as claimed in claim 1, wherein the confining zone includes a curved protrusion horizontally projected toward the second clamping member and a first channel vertically extending through a center of the curved protrusion, and the clamping zone includes a curved recess corresponding to the curved protrusion and a second channel corresponding to the first channel; and the first and the second channel together defining the clamping space in the movable casing for the cymbal rod to assemble and be clamped thereto.

3. The cymbal rod adjusting and locating mechanism as claimed in claim 2, wherein the screw hole formed on the first clamping member is located on the curved protrusion.

4. The cymbal rod adjusting and locating mechanism as claimed in claim 1, wherein the guiding mechanism includes at least one guide post located on and laterally projected from the adjoining surface of the first clamping member, and at least one guide hole formed on and sunken from the adjoining surface of the second clamping member to locate corresponding to the guide post.

5. The cymbal rod adjusting and locating mechanism as claimed in claim 1, further comprising a second elastic element located between the fixed casing and the first clamping member for elastically pushing the fixed casing and the first clamping member away from each other.

6. The cymbal rod adjusting and locating mechanism as claimed in claim 1, further comprising a locating device provided on two adjoining surfaces of the fixed casing and the movable casing for a user to change an angle by which the movable casing is rotated relative to the fixed casing.

7. The cymbal rod adjusting and locating mechanism as claimed in claim 6, wherein the locating device includes an annular tooth array and at least one locating tooth for meshing with the annular tooth array.

8. The cymbal rod adjusting and locating mechanism as claimed in claim 1, further comprising an indicator unit provided on outer circumferential surfaces of the fixed casing and the movable casing at positions adjoining a joint between the two casings for indicating an angle by which the movable casing is rotated relative to the fixed casing.

9. The cymbal rod adjusting and locating mechanism as claimed in claim 1, wherein the indicator unit includes a set of angle scales provided on the outer circumferential surface of the fixed casing and at least one index scale provided on the outer circumferential surface of the movable casing for correspondingly aligning with one of the angle scales when the movable casing is rotated.

* * * * *